US005460287A

United States Patent [19]

Cargile et al.

[11] Patent Number: 5,460,287

[45] Date of Patent: Oct. 24, 1995

[54] BLOW-MOLDED WIDE MOUTH PLASTIC CONTAINER AND INJECTION-MOLDED LID

[75] Inventors: David W. Cargile, Lititz; Gerald J. Claes, Lancaster; Walter R. Herring, Unionville; Joseph A. Kuczynski, York, all of Pa.

[73] Assignee: Graham Packaging Corporation, York, Pa.

[21] Appl. No.: 198,894

[22] Filed: Feb. 18, 1994

[51] Int. Cl.[6] ..... B65D 41/46

[52] U.S. Cl. ..... 220/306; 220/276; 215/256; 215/354; 215/40

[58] Field of Search ..... 215/254, 256, 215/305, 354, 31; 220/306, 276

[56] References Cited

U.S. PATENT DOCUMENTS

| | | | |
|---|---|---|---|
| 3,171,458 | 3/1965 | Strong . | |
| 3,263,724 | 8/1966 | Mojonnier . | |
| 3,298,415 | 1/1967 | Klygis . | |
| 3,338,446 | 8/1967 | Faulstich . | |
| 3,352,448 | 11/1967 | Livingstone . | |
| 3,482,725 | 12/1969 | Exton . | |
| 3,608,765 | 9/1971 | Faulstich . | |
| 3,672,528 | 6/1972 | Faulstich . | |
| 3,707,240 | 12/1972 | Wilson . | |
| 3,901,404 | 8/1975 | Feldman . | |
| 3,940,004 | 2/1976 | Faulstich | 215/256 |
| 3,980,195 | 9/1976 | Fillmore | 215/256 |
| 3,991,904 | 11/1976 | Davis et al. . | |
| 4,141,463 | 2/1979 | Smith . | |
| 4,162,736 | 7/1979 | Faulstich . | |
| 4,166,522 | 9/1979 | Faulstich . | |
| 4,305,517 | 12/1981 | Dennis | 215/256 |
| 4,496,066 | 1/1985 | Bullock, III | 215/320 |
| 4,566,601 | 1/1986 | Kuenzig . | |
| 4,589,561 | 5/1986 | Crisci | 215/256 |
| 4,593,830 | 6/1986 | Bullock | 215/256 |
| 4,625,876 | 12/1986 | Bullock, III | 215/256 |
| 4,676,389 | 6/1987 | Bullock . | |
| 4,691,834 | 9/1987 | Bullock, III . | |
| 4,699,286 | 10/1987 | Nolan . | |
| 4,699,287 | 10/1987 | Bullock . | |
| 4,784,296 | 11/1988 | Bullock . | |
| 4,798,301 | 1/1989 | Bullock et al. | 215/256 |
| 4,815,617 | 3/1989 | Cullum . | |
| 4,815,620 | 3/1989 | Bullock, III | 215/256 |
| 4,828,128 | 5/1989 | Tackles . | |
| 4,844,268 | 7/1989 | Bullock, III . | |
| 4,856,667 | 8/1989 | Thompson . | |
| 4,903,849 | 2/1990 | Wallman . | |
| 4,911,316 | 3/1990 | Tackles . | |
| 4,933,133 | 6/1990 | Brown et al. . | |
| 4,934,546 | 6/1990 | Markley . | |
| 4,966,292 | 10/1990 | Marino | 215/256 |
| 5,036,991 | 8/1991 | Wallman . | |
| 5,143,235 | 9/1992 | Repp . | |
| 5,207,340 | 5/1993 | Cochrane | 215/256 |

*Primary Examiner*—Allan N. Shoap
*Assistant Examiner*—Vanessa Caretto
*Attorney, Agent, or Firm*—Howson and Howson

[57] ABSTRACT

A wide-mouth, plastic container and lid. A leak-resistant seal is disclosed that withstands the stresses and strains imposed due to rough handling. An easily removable, tamper-evident lid is disclosed.

2 Claims, 3 Drawing Sheets

FIG. 1
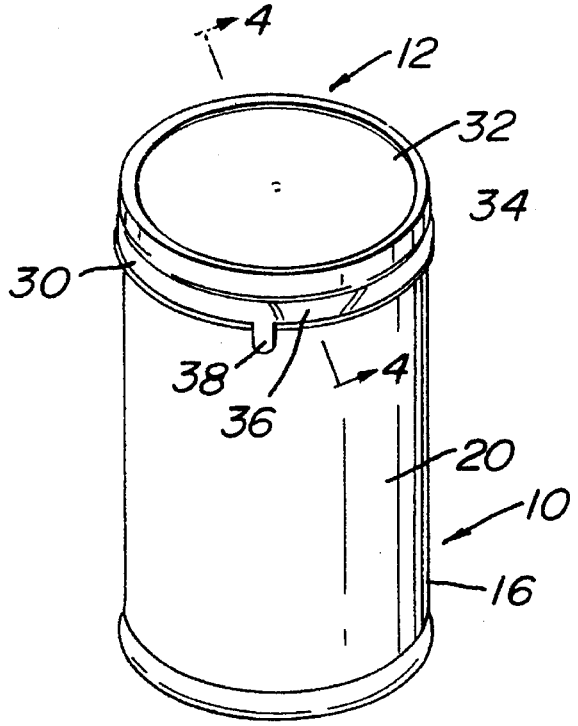
FIG. 2
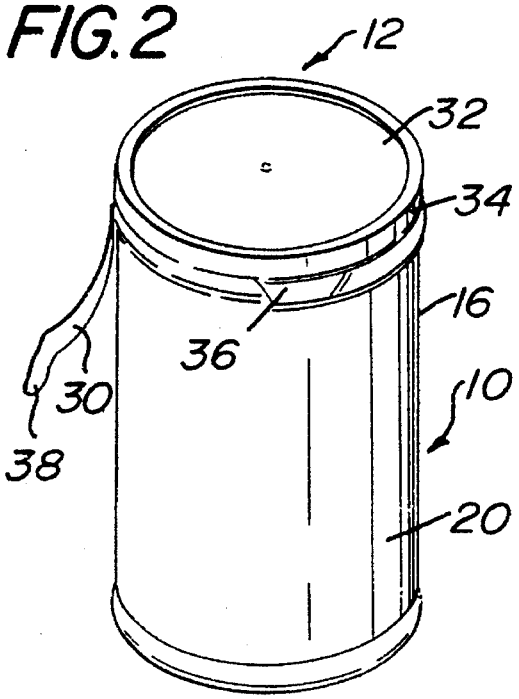
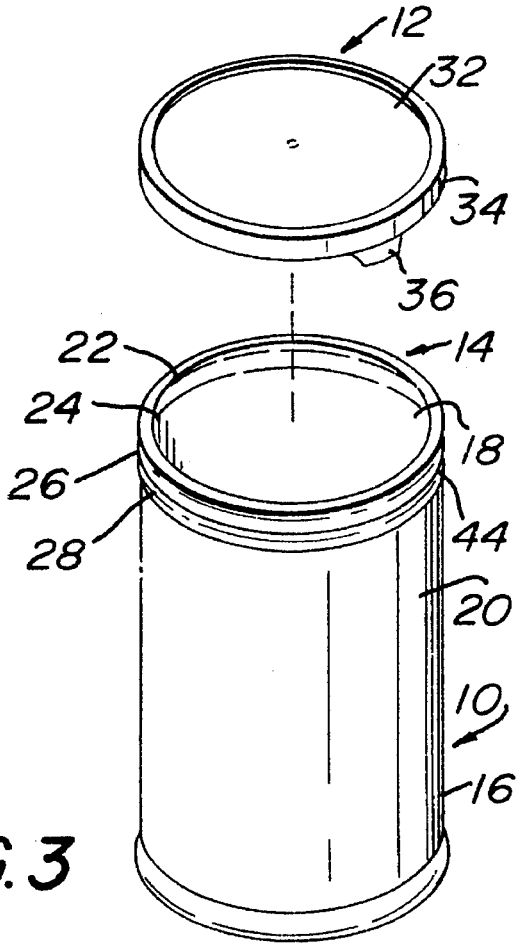
FIG. 3

BLOW-MOLDED WIDE MOUTH PLASTIC CONTAINER AND INJECTION-MOLDED LID

FIELD OF THE INVENTION

The present invention relates to a plastic container and lid and more particularly, the present invention relates to improvements in providing a leak-resistant seal in a blow-molded wide-mouth container and injection molded-lid.

BACKGROUND OF THE INVENTION

Many food and beverage products sold to the consuming public are provided in wide mouth jar-like containers. Consumers have indicated that they prefer containers which initially have a tamper-evident seal, and which can be resealed after opening for partial consumption of the contents. It is imperative that any such container have a seal which is leak-resistant from the time the lid is applied until end use by the consumer.

While seal integrity is important, the lid should allow for easy removal by the consumer. Therefore, it is imperative that a commercially-desirable container have a reliable seal and a lid which is easily removed, even if the container and its contents are frozen.

Conventional containers for frozen juice concentrate have been constructed with a cardboard sidewall and metallic end lids. This construction does not provide a container which is well suited for partial consumption of its contents and re-closure. Furthermore, removal of the lid from the frozen container is not always without difficulty.

With this in mind, containers made of plastic are well suited for frozen juice concentrates, and other consumer products. Plastic containers made from an injection-molded process could be used for this purpose, since their design provides precise manufacturing control of dimensions such as heights, depths, outside and inside diameters, wall thicknesses, etc. However, injection molded plastic containers are not currently being recycled and this is a major disadvantage of such containers. Blow molding processes for making plastic containers could be utilized, since such containers are easily recyclable. However, with blow molding techniques, dimensional tolerances are more difficult to control.

A problem associated with freezable blow-molded containers is the need to accommodate slight changes in configuration due to changes in volume as the liquid freezes after the container has been sealed with a lid . The container and lid seal must remain leak-resistant not only under these conditions, but also throughout transportation, and display, up to final usage by the consumer.

Some prior art examples of containers and cooperating lid designs having a tamper-evident tear strip and sealing arrangement may be found in U.S. Pat. Nos. 4,162,736; 4,166,552; 4,496,066; 4,589,561; 4,691,834; 4,699,287; 4,699,286; 4,798,301; 4,938,489; and 5,036,991.

Although various ones of the referenced containers and lids may function satisfactorily for their intended purposes, there is a need for a plastic container and lid which provides a leak-resistant seal capable of accommodating reductions and increases in volume of the container's contents. The lid should be tamper-resistant, easy to manipulate and capable of reuse on the container. Furthermore, such a container and lid should also be capable of being manufactured in high-speed equipment utilizing a minimum of plastic to minimize the cost of manufacture.

OBJECTS OF THE INVENTION with the foregoing in mind, a primary object of the present invention is to provide a novel multipurpose plastic container having an improved lid seal.

Another object of the present invention is to provide an improved container and lid combination that withstands the rigors of the filling and freezing processes, yet remains leak-resistant throughout normal handling of the container.

A further object of the present invention is to provide a tamper-evident plastic container and lid combination.

A still further object of the present invention is to provide a blow-molded wide mouth plastic container and injection-molded lid having a tamper-evident tear strip which, after removal, enables the kid to be removed from the container and reapplied.

SUMMARY OF THE INVENTION

More specifically, the present invention provides a leak-resistant, cold filled and freezable, blow-molded container having an open end and a tamper-evident injection molded lid removably associated with the container to close the open end. The container has a pair of upper and lower beads extending around the container outer periphery adjacent to the open end. The open end has an inturned tapered sealing flange extending around the container inner periphery for cooperating with the lid to provide a seal.

The lid has a skirt circumscribing the outer periphery of the container for engaging the upper and lower beads. The skirt has tearable means forming a tear strip extending about substantially the entire periphery of the container open end. The tear strip has an integral pull-tab depending below the lower bead and an integral push-up tab adjacent the pull-tab. The push-up tab is formed upon removal of the tear strip by pulling on the pull-tab in a circular motion about the container.

The lid has an annular depending plug wall telescopically receivable within the container opening. The lid skirt also has an inner peripheral recessed surface portion located opposite the plug wall for cooperating with the inturned sealing flange when the lid is installed to reversely turn the sealing flange against the plug wall and thereby form a fluid tight seal.

A rib is provided around the inner periphery of the skirt below the recessed surface. The rib is configured relative to the push-up tab and the outer surface of the open end of the container adjacent the sealing flange to enable the lid to peel-off easily.

BRIEF DESCRIPTION OF THE DRAWINGS

The foregoing and other objects, features and advantages of the present invention should become apparent from the following description when taken in conjunction with the accompanying drawings, in which:

FIG. 1 is a perspective view of a container and a lid embodying the present invention;

FIG. 2 is a perspective view of a tear strip partially removed from the lid;

FIG. 3 is an exploded perspective view of the container and lid with the tear strip removed;

DETAILED DESCRIPTION OF PREFERRED EMBODIMENT

Figure 4:
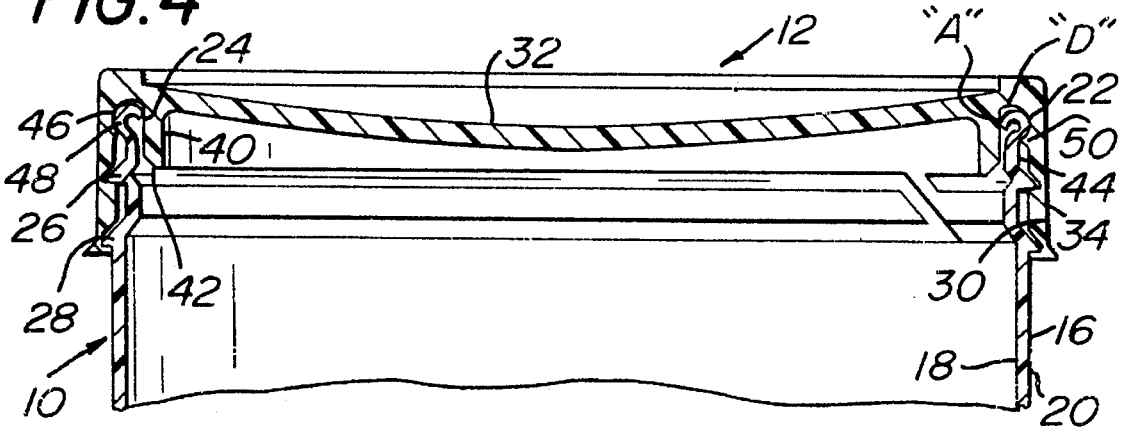
FIG. 4 is a cross sectional view taken along line 4—4 of FIG. 1.

Referring now to the drawings, FIG. 1 illustrates a cold fillable, freezable, blow-molded plastic container 10 and injection-molded lid 12 which embody the present invention. The container 10 is particularly suited to be filled with a liquid initially in a cold state, sealed and subsequently frozen into a solid state. As the liquid takes on a solid form, its volume increases in the sealed container. As discussed heretofore, various plastic containers and lid designs which have been proposed have met with varying degrees of commercial success.

The present invention overcomes the limitations of prior art container and lid combinations by means of a novel container mouth seal and lid configuration which provides a commercially desirable container which can withstand the rigors of freezing, yet which is leak-resistant before opening and use by the consumer. The lid includes tamper-evidence, and is easy to remove, even when the container and contents are still frozen. In addition, the container and lid allows the consumer to reapply the lid onto the container after partial withdrawal of the contained product, or for other purposes.

Figure 6:
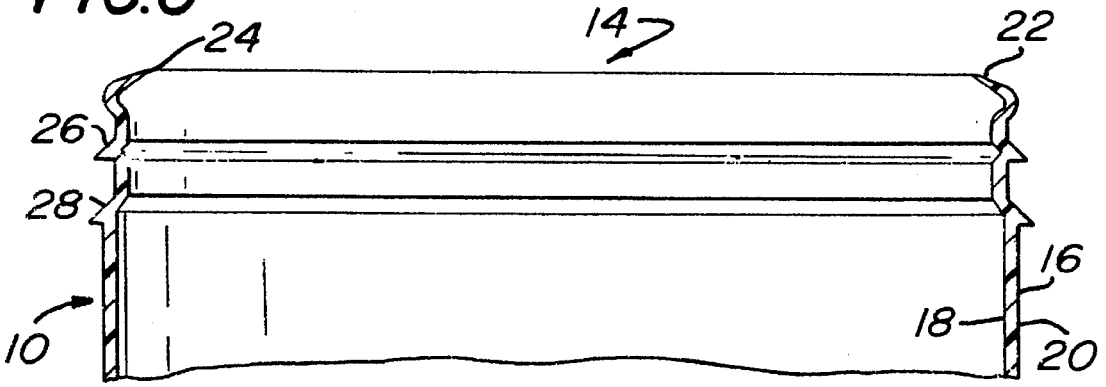
FIG. 6 is a cross sectional view of the container open end.

To this end, the container 10 has a wide mouth circular open end 14. As seen in FIG. 1, the container 10 has an outer periphery 16 which is of a substantially constant diameter throughout the length of the container 10. As best seen in FIG. 6, the container 10 has an inner periphery 18 which also has a substantially constant diameter throughout the length of the container 10. The thickness of the sidewall 20 of the container 10 is kept as thin as possible to minimize the quantity of plastic required to manufacture the container 10.

The portion of the container 10 adjacent the open end 14 is designed to cooperate with the lid 12 to provide a leak resistant yet easy to open seal between the lid 12 and the container 10. As seen in FIG. 6, the container 10 has an inturned sealing flange 22 directly adjacent to its open end 14. The upper face of the flange 22 is finished smooth, as by means of well-known finish equipment such as a reamer, and tapers to a feathered free-edge 24. See FIG. 6. As will be discussed in detail later, the portion of the flange adjacent to the free edge 24 is flexible and thereby aids in providing a significant line of sealing engagement between the container 10 and the lid 12.

The container 10 also has an upper bead 26 and a lower bead 28 adjacent to the open end 14. The upper and lower beads, 26 and 28, respectively extend around the outer periphery 16 of the container 10 for engaging a tear strip 30 on the lid 12, as will be discussed. The beads 26 and 28 taper radially outwardly and downwardly and have flat bottom surfaces disposed perpendicular to the outer surfaces of the container body 10.

Figure 8:
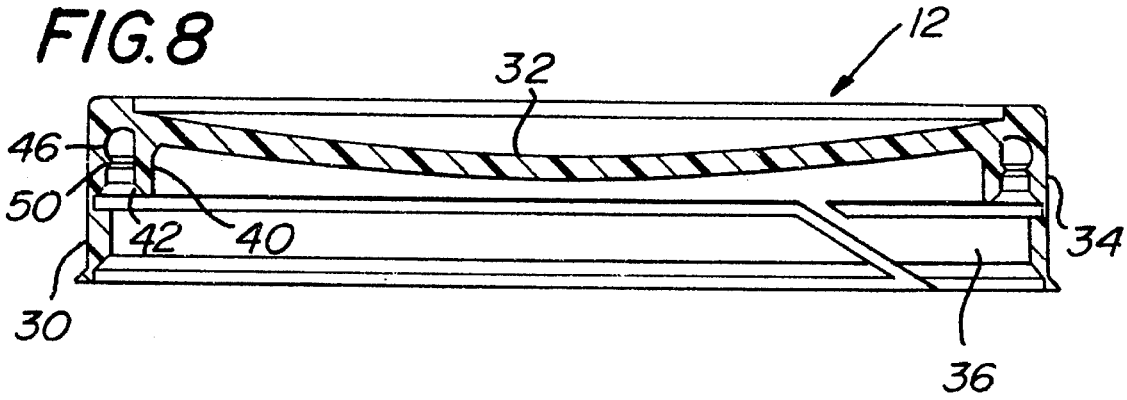
FIG. 8 is a cross sectional view taken along the line 8—8 of FIG. 7.

The lid 12, as seen in FIGS. 1–3, provides a means of closing the open end 14 of the container 10, of providing an initial tamper resistant seal, and of providing a reusable seal once the tamper resistant seal is removed. As seen in FIG. 8, the lid 12 has a circular top portion 32 and a skirt 34. The skirt 34 girds the outer periphery 16 of the container 10, extending therealong from the open mouth, or end, 14. The skirt 34 is provided with a reduced thickness line providing a tearable means defining a tear strip 30 which extends substantially about the outer periphery 16 of the container open end 14. The tear strip 30 has a pull-tab 38 which projects from the outer skirt 34. The pull-tab 38 is designed to be grasped by the consumer to remove the tear strip 30 by pulling on it in a circular fashion about the container in a well-known manner. The portion of the skirt 34 which does not form the tear strip 30, remains to form a push-up tab 36. The push-up tab 36 is used for removing the lid 12 after the tear strip 30 has been completely removed from the lid 12 by enabling upward thumb pressure to be applied while gripping the container body.

As best seen in FIG. 4, the lid 12 has an inner annular plug wall 40 which depends from the top 32 and which is telescopically received within the container open end 14. The plug wall 40 has an outwardly-facing chamfered surface portion 42 located along its lower end portion to aid in providing the fluid tight seal shown in FIG. 4, at location "A", where the free edge 24 of the inturned flange 22 provides a line of sealing engagement with the lid plug wall 40. Distortion of the flange 22 occurs during installation of the lid, when the plug wall chamfered surface 42 engages the free edge of the inturned tapered sealing flange 22 and reversely turns it into a hairpin shaped configuration. This unique hairpin shape establishes positive sealing engagement with the lid 12 and provides a seal capable of remaining leak-resistant even under the above-described adverse usage conditions.

In order to ensure reverse turning of the flange 22 into its hairpin sealing shape during installation of the lid 12, the inner peripheral surface of the skirt is provided with a curved recess 46 which confronts the lid plug wall 40 adjacent its top 32 when installed. The skirt thereby forces the tapered flange 22 against the outer surface of the plug wall 40 to ensure leak resistance. A small gap "D" is provided to accommodate slight relative movements that might occur between the lid and container.

Figure 5:
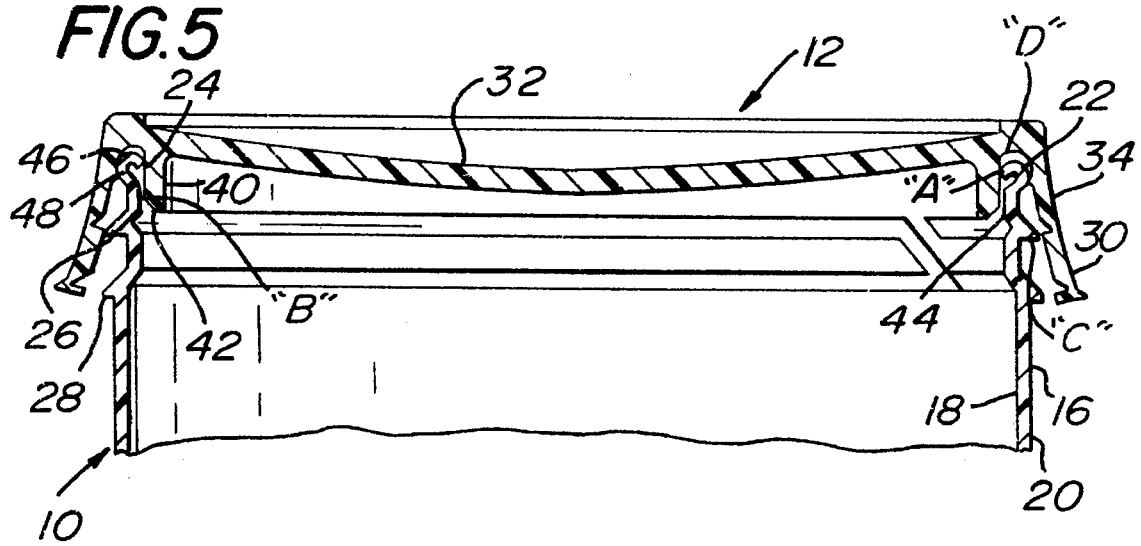
FIG. 5 is a cross sectional view showing the deflection of the lid as it is applied to the container after filling.

The design of the container 10 and lid 12 allows the lid 12 to be installed on a container 10 pre-filled with a liquid, powder, or the like. As seen in FIG. 5, wherein the lid 12 is shown grossly distorted for purposes of illustration, when the lid 12 is initially installed, a slight collapsing or buckling of the neck area 44 occurs at point "B". The lid 12 also stretches slightly circumferentially. This allows engagement to occur at point "C" between the outer skirt 34 of the lid 12 and the upper bead 26 of the container 10. Once the lid 12 is in position, additional positive locking occurs under the upper and lower beads, 26 and 28.

Figure 7:
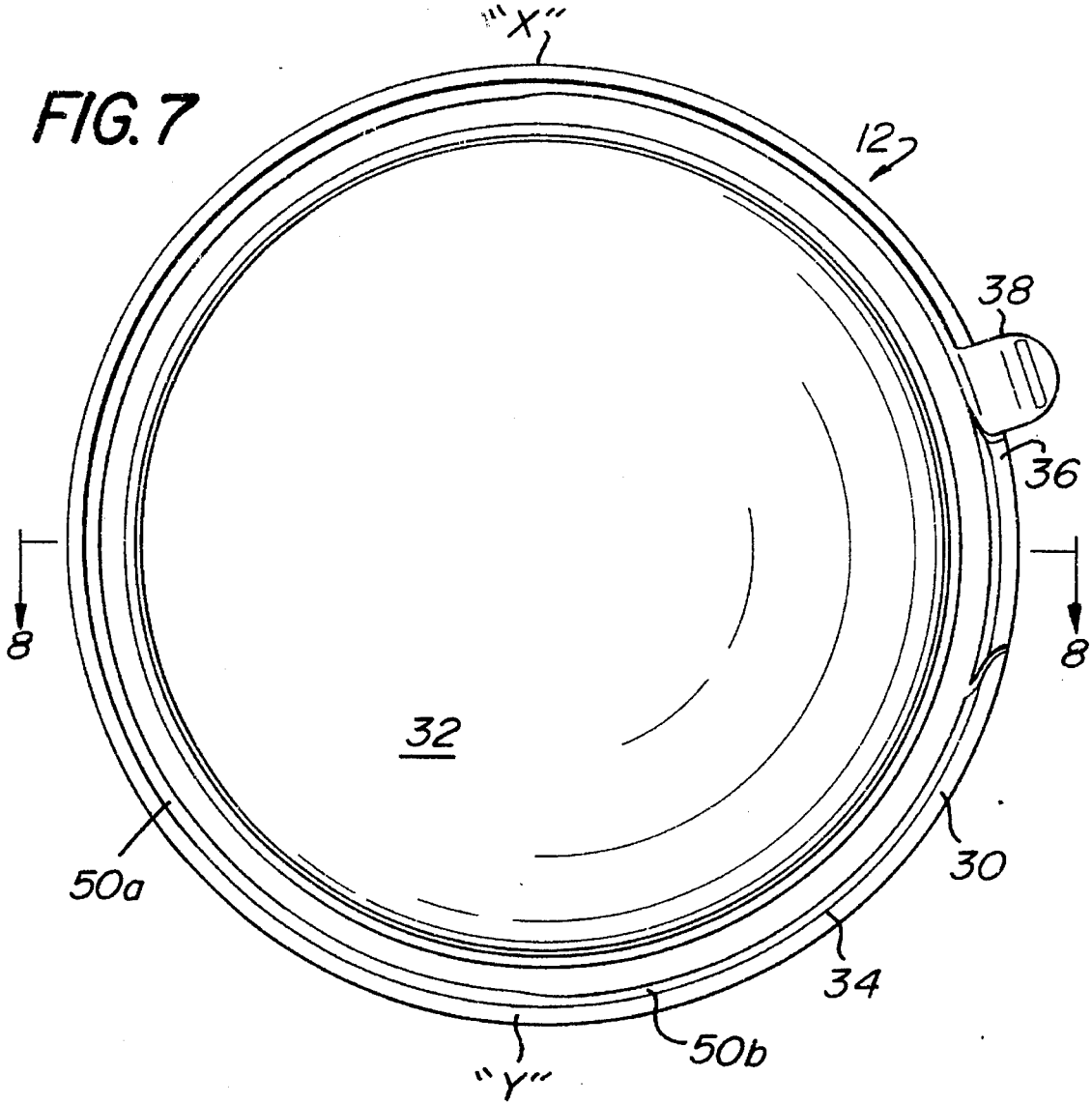
FIG. 7 is an inverted plan view of a lid embodying the present invention.

The lid 12 can be easily removed and replaced. To this end, a rib 50 is provided on the inner periphery of the skirt 34 immediately below the recess 46. The rib 50 extends completely around the inner periphery of the skirt, but has two arcuate portions **50*a* and 50*b*. The arcuate portion 50*a* extending between points "X" and "Y", as seen in FIG. 7, is diametrically opposite push up tab 36. The rib 50*a*, in this zone, extends further into the interior of the lid then the rib portion 50*b* on the same side as the push up tab 36. For instance, the rib portion 50*a* opposite the push up tab 36 extends 0.017 inch into the lid while the rib portion 50*b* on the same side as the push up tab 36 extends only 0.004 inch. This rib structure, being located below the skirt recess 46, not only aids in sealing, and abuse resistance, but also enables the lid to be removed readily simply by applying an upward pressure to the push up tab 36 and flexing the lid top 32**. In addition, the hairpin shape of the sealing flange provides flexure to the open end, even when frozen, to allow for easy removal of the lid and positive locking of the lid when sealed.

The above container is particularly suited for manufacture by blow molding techniques. Preferably, the lid is injection-molded. A preferred material for the container body is HDPE/PP. A preferred material for the lid is LLDPE/HDPE. While differences in these two processes can present manufacturing problems, the aforedescribed container and lid design overcome them.

While a preferred embodiment of the present invention has been described in detail, various modifications, alterations, and changes may be made without departing from the spirit and scope of the present invention as defined in the appended claims.

We claim:

1. A leak-resistant plastic container and closure, the container having an open end, an inner periphery, and an outer periphery, and the closure being a lid removably associated with the container for closing said open end, said container having a pair of upper and lower beads extending around said outer periphery adjacent said open end and having an inturned tapered sealing flange extending around said inner periphery at said open end, said lid having a skirt engaging said beads, said skirt having tearable means forming a tear strip extending substantially about said outer periphery of the container end to form a tear strip having an integral pull tab depending below the lower bead and an integral push-up tab adjacent said pull tab, said push-up tab being formed upon removal of said tear strip by pulling on said pull tab, said lid having an inner annular depending plug wall telescopically receivable within said open end, said lid having an inner peripheral recessed surface portion confronting said plug wall for cooperating with said inturned tapered sealing flange and said lid plug wall when installed to reversely turn said sealing flange and thereby form a fluid-tight seal with said lid, said lid having a peripheral inwardly extending rib located below said inner peripheral recessed surface, said rib extending inwardly toward said plug wall a greater distance throughout a predetermined arcuate extent furthest from said push up tab than adjacent thereto for enabling easy removal of said lid.

2. In a plastic container and closure, the container having a body with an open end, the open end being of substantially the same size as the body, the body having an inner and outer periphery, and the closure being a lid for closing the open end, the improvement comprising:

an upper bead and a lower bead extending around the outer periphery of the container adjacent to the open end;

an inturned sealing flange extending around the inner periphery of the container at the open end, said inturned sealing flange tapering to a feathered free edge;

an outer skirt integral with the lid for engaging said upper and lower beads;

a tear strip formed in said outer skirt and extending substantially about the outer periphery of the container open end;

an integral pull-tab formed in said tear strip and depending below said lower bead of the container;

an integral push-up tab formed in said outer skirt adjacent to said pull-tab, said push-up tab being formed upon removal of said tear strip by pulling on said pull-tab about the outer periphery of the container;

an inner annular dependent plug wall formed in the lid, said plug wall being spaced from said outer skirt so that said plug wall is capable of being telescopically received within the open end; and an inner peripheral recessed surface portion located on the lid opposite said plug wall for cooperating with said inturned sealing flange and said lid plug wall when installed to reversely turn said sealing flange and thereby form a fluid tight seal with the lid, said inturned sealing flange having an upper curved portion and being reversely-turned into a hairpin shape when the lid seals said open end of the container for creating a line of sealing pressure between the tapered free edge and the plug wall, said outer skirt having a peripheral inwardly extending rib located directly below said inner peripheral recessed surface portion cooperating with said upper bead of said container to provide positive locking engagement between said upper curved portion of said inturned sealing flange and said lid, to provide positive locking between the lid and the container, and to maintain the reversely-turned hairpin configuration of the sealing flange, said rib extending inwardly a greater distance throughout a predetermined arcuate extent furthest from said push up tab than adjacent thereto for enabling easy removal of said lid.

* * * * *

UNITED STATES PATENT AND TRADEMARK OFFICE

CERTIFICATE OF CORRECTION

PATENT NO. : 5,460,287

DATED : October 24, 1995

INVENTOR(S) : D. W. Cargile, G. J. Claes, W. R. Herring, J. A. Kuczynski

It is certified that error appears in the above-identified patent and that said Letters Patent is hereby corrected as shown below:

Column 1, line 9, replace the "-" after "molded" and place it before "molded"; (2nd occurrence).

Column 2, line 1, "with" should be --With--;

Column 2, line 15, "kid" should read --lid--.

Signed and Sealed this

Twentieth Day of February, 1996

*Attest:*

*Attesting Officer*

Bruce Lehman

BRUCE LEHMAN

*Commissioner of Patents and Trademarks*